US010273721B1

(12) United States Patent
Chen et al.

(10) Patent No.: US 10,273,721 B1
(45) Date of Patent: Apr. 30, 2019

(54) KEY DRIVEN INTERNAL LOCKING DEVICE FOR CABINET DRAWERS

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKE Co., Ltd, Taichung (TW)

( * ) Notice: Subject to any disclaimer, the term of this patent is extended or adjusted under 35 U.S.C. 154(b) by 0 days.

(21) Appl. No.: 15/897,686

(22) Filed: Feb. 15, 2018

(51) Int. Cl.
*E05B 65/462* (2017.01)
*E05B 55/00* (2006.01)
*E05B 63/14* (2006.01)

(52) U.S. Cl.
CPC ..... *E05B 65/462* (2013.01); *E05B 55/00* (2013.01); *E05B 63/143* (2013.01)

(58) Field of Classification Search
CPC ..... E05B 65/462; E05B 55/00; E05B 63/143; E05B 65/46; E05B 65/461; E05B 65/463
USPC ..... 70/78–88; 292/DIG. 18; 312/216–219, 312/221
See application file for complete search history.

(56) References Cited

U.S. PATENT DOCUMENTS 1,613,731 A * 1/1927 Stockov ..... E05B 65/462 312/221
1,847,106 A * 3/1932 Turner ..... E05B 65/462 312/194
3,371,974 A * 3/1968 Vermeersch ..... E05B 65/463 312/218
3,622,216 A * 11/1971 Haunost ..... E05B 65/463 312/219
5,257,860 A * 11/1993 Slivon ..... E05B 65/462 312/218
5,782,545 A * 7/1998 Kahara ..... E05B 65/464 312/217
5,862,689 A * 1/1999 Wen ..... E05B 65/465 292/DIG. 18
6,082,839 A * 7/2000 Chiku ..... E05B 65/463 312/217
6,347,848 B1 * 2/2002 Cho ..... E05B 65/462 292/DIG. 18
6,637,843 B2 * 10/2003 Westwinkel ..... E05B 65/464 312/218
6,722,167 B1 * 4/2004 Hsu ..... E05B 65/462 292/119
6,742,854 B2 * 6/2004 Chen ..... E05B 65/463 312/217
6,896,342 B1 * 5/2005 Cheng ..... E05B 65/463 312/217

(Continued)

*Primary Examiner* — Lloyd A Gall

(57) ABSTRACT

A cabinet includes drawers each having a rear latch; and a key driven internal locking device including a rod including a front key hole and a rear bent member; a longitudinal member secured to an inner surface of a rear end of the cabinet and including a longitudinal groove; a sliding member slidably disposed in the longitudinal groove and including rectangular openings on a front surface, a protrusion on a top of the sliding member, and an upper driven member secured to the front surface of the sliding member and having a through hole with the bent member passing through; fastening plates each secured to two sides of the longitudinal member wherein the uppermost fastening plate has a pivot hole with the rear end of the rod passing through into the longitudinal member; and a concave member in an upper portion of the longitudinal member.

1 Claim, 11 Drawing Sheets

(56) References Cited

U.S. PATENT DOCUMENTS

| | | | | |
|---|---|---|---|---|
| 7,144,092 | B1 * | 12/2006 | Chang | E05B 65/462 312/217 |
| 7,264,319 | B2 * | 9/2007 | Cheng | E05B 65/462 312/216 |
| 7,784,887 | B2 * | 8/2010 | Grela | B25H 3/028 312/218 |
| 7,891,222 | B2 * | 2/2011 | Ratkus | E05B 47/0012 70/278.7 |
| 2005/0210933 | A1 * | 9/2005 | Wen | E05B 65/463 70/78 |
| 2006/0138912 | A1 * | 6/2006 | Chen | E05B 65/462 312/217 |

* cited by examiner

KEY DRIVEN INTERNAL LOCKING DEVICE FOR CABINET DRAWERS

BACKGROUND OF THE INVENTION

1. Field of the Invention

The invention relates to cabinet locks and more particularly to a locking device mounted on an inner surface of a back of a cabinet, the locking device being adapted to be locked or unlocked by inserting a key into a key hole of a rod rotatably secured to a sliding member and turning the key so that once the locking device is unlocked, one of drawers is allowed to open.

2. Description of Related Art

U.S. Pat. No. 6,742,854 to Chen discloses an anti-inclination and internal locking device for a cabinet comprising a cabinet body, at least two drawers disposed in the cabinet body, a projecting body disposed on rear side of each drawer, a base seat fixedly disposed on inner side of a rear wall board of the cabinet body corresponding to each drawer, a slide seat slidably fitted in the base seat and movable between a first position and a second position and a first and a second connecting sections respectively disposed at one end of the base seat and one end of the slide seat. The projecting body has an activating section and a stop section. The slide seat is formed with an opening corresponding to the projecting body. After one drawer is drawn out, the activating section of the projecting body of the drawn out drawer drives the slide seat and then the first connecting section is connected with the second connecting section to make the slide seat positioned in the first position, whereby the stop section of the projecting body of the other drawer is engaged with the corresponding opening.

While the patent enjoys its success in the market, continuing improvements in the exploitation of a key driven internal locking device for cabinet drawers are constantly being sought.

SUMMARY OF THE INVENTION

It is therefore one object of the invention to provide a cabinet comprising a plurality of drawers each comprising two slides on outer surfaces of two sides respectively, and a latch on an outer surface of a rear end; and a key driven internal locking device comprising a rod including a key hole on a front end, and a bent member adjacent to a rear end; a longitudinal member secured to an inner surface of a rear end of the cabinet and including a longitudinal groove; a sliding member slidably disposed in the longitudinal groove and including a plurality of rectangular openings on a front surface wherein a predetermined number of the rectangular openings correspond to the latches, a protrusion on a top of the sliding member, and an upper driven member secured to the front surface of the sliding member and having a through hole with the bent member passing through; a plurality of fastening plates each secured to two sides of the longitudinal member wherein an uppermost one of the fastening plates has a pivot hole with the rear end of the rod passing through into the longitudinal member; and a concave member fastened in an upper portion of the longitudinal member and above the protrusion; wherein in a locked state of the cabinet, the bent member projects upward, the protrusion is complementarily disposed in the concave member, each latch is inserted into the corresponding rectangular opening, each latch is blocked by an inner surface of the front surface of the sliding member, and all of the drawers are locked; wherein in response to inserting a key into the key hole and clockwise rotating the key, the rod clockwise rotates to push the driven member downward, the sliding member moves downward to clear the protrusion out of the concave member, the latches are not blocked by the inner surface of the front surface of the sliding member, and all of the drawers are unlocked; and wherein in response to pulling out one drawer, the latch pushes the front surface of the sliding member upward to insert the protrusion into the concave member and the latches of the remaining drawers are blocked by the inner surface of the front surface of the sliding member, and the remaining drawers are locked.

The above and other objects, features and advantages of the invention will become apparent from the following detailed description taken with the accompanying drawings.

BRIEF DESCRIPTION OF THE DRAWINGS

FIG. 10 is a view similar to FIG. 9, the topmost drawer being pushed in.

DETAILED DESCRIPTION OF THE INVENTION

Figure 1:
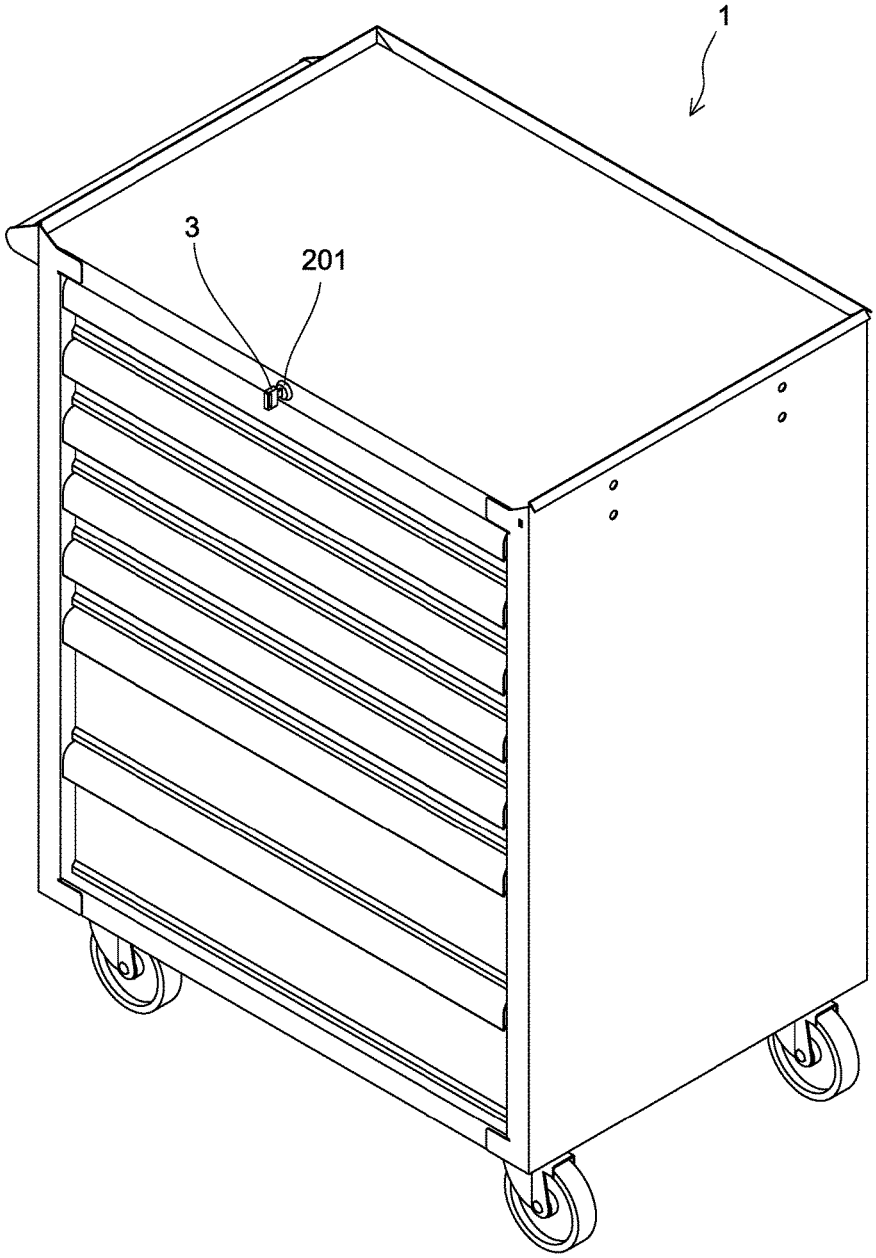
FIG. 1 is a perspective view of a wheeled cabinet incorporating a key driven locking device for drawers according to the invention.
Figure 1A:
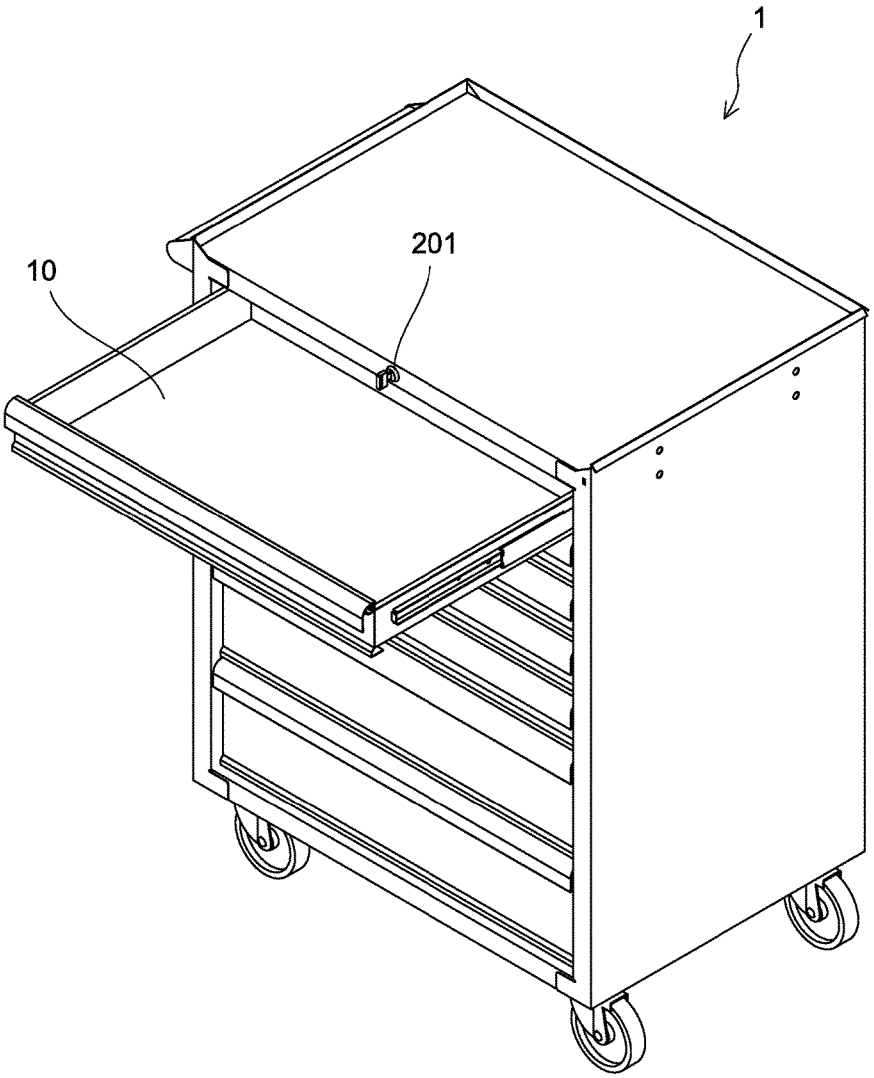
FIG. 1A is a view similar to FIG. 1 with a drawer drawn out.
Figure 2:
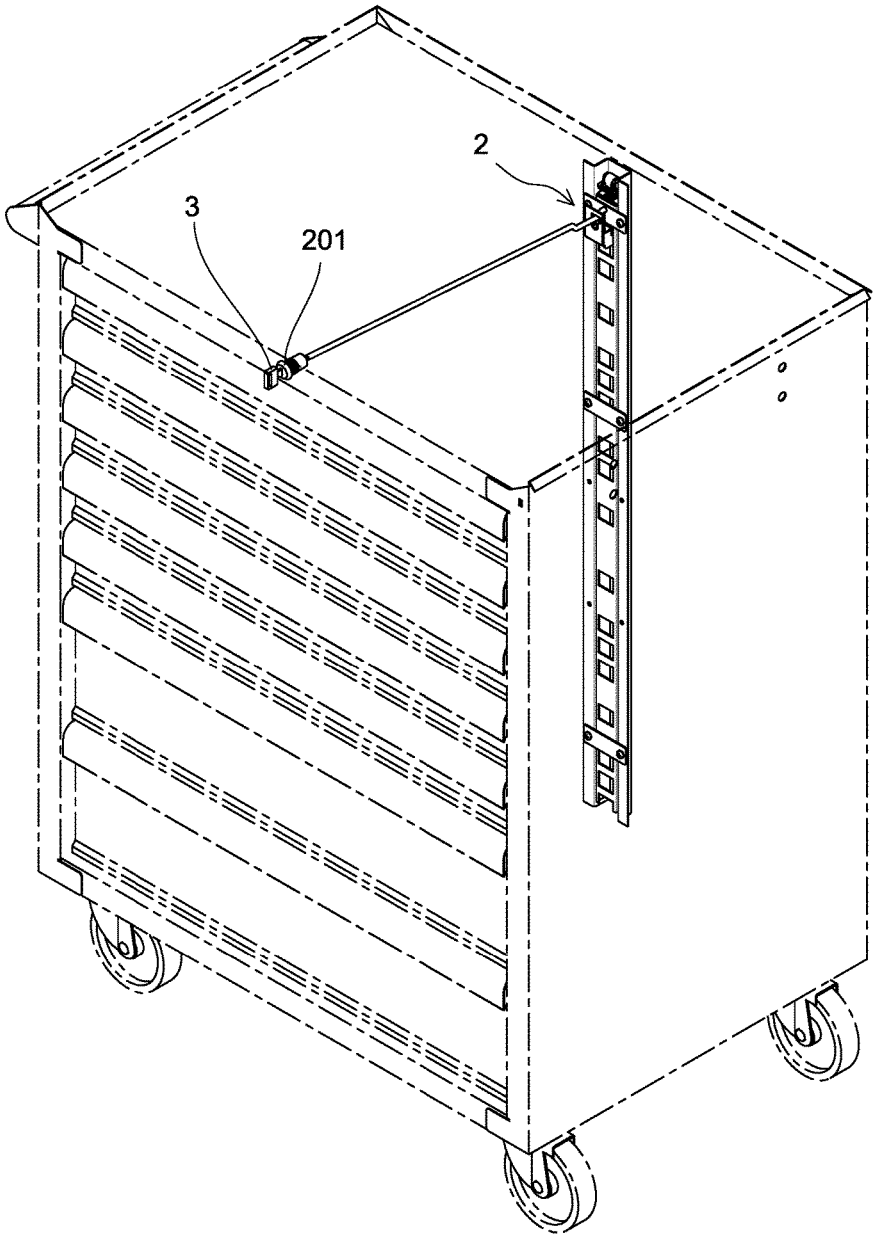
FIG. 2 is a view similar to FIG. 1 showing a key, a rod and other elements of the locking device in a transparent manner.
Figure 3:
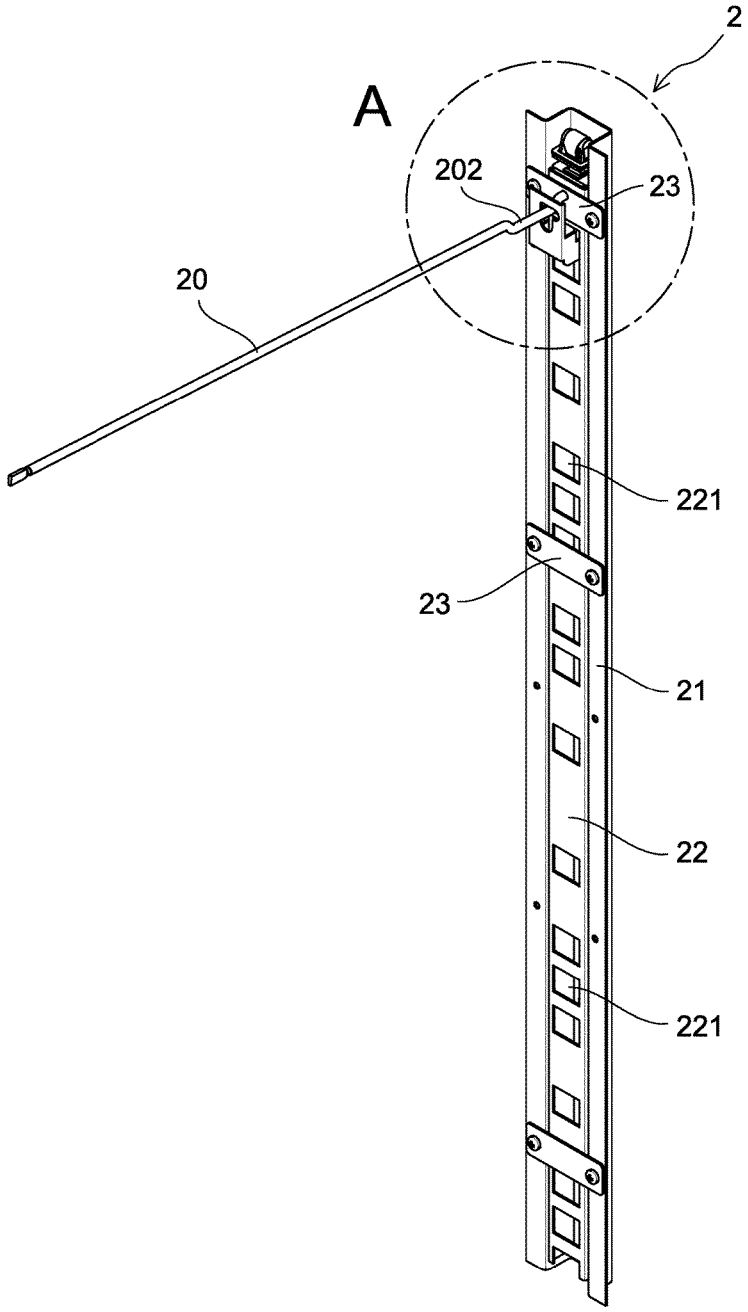
FIG. 3 is a perspective view of the locking device.
Figure 4:
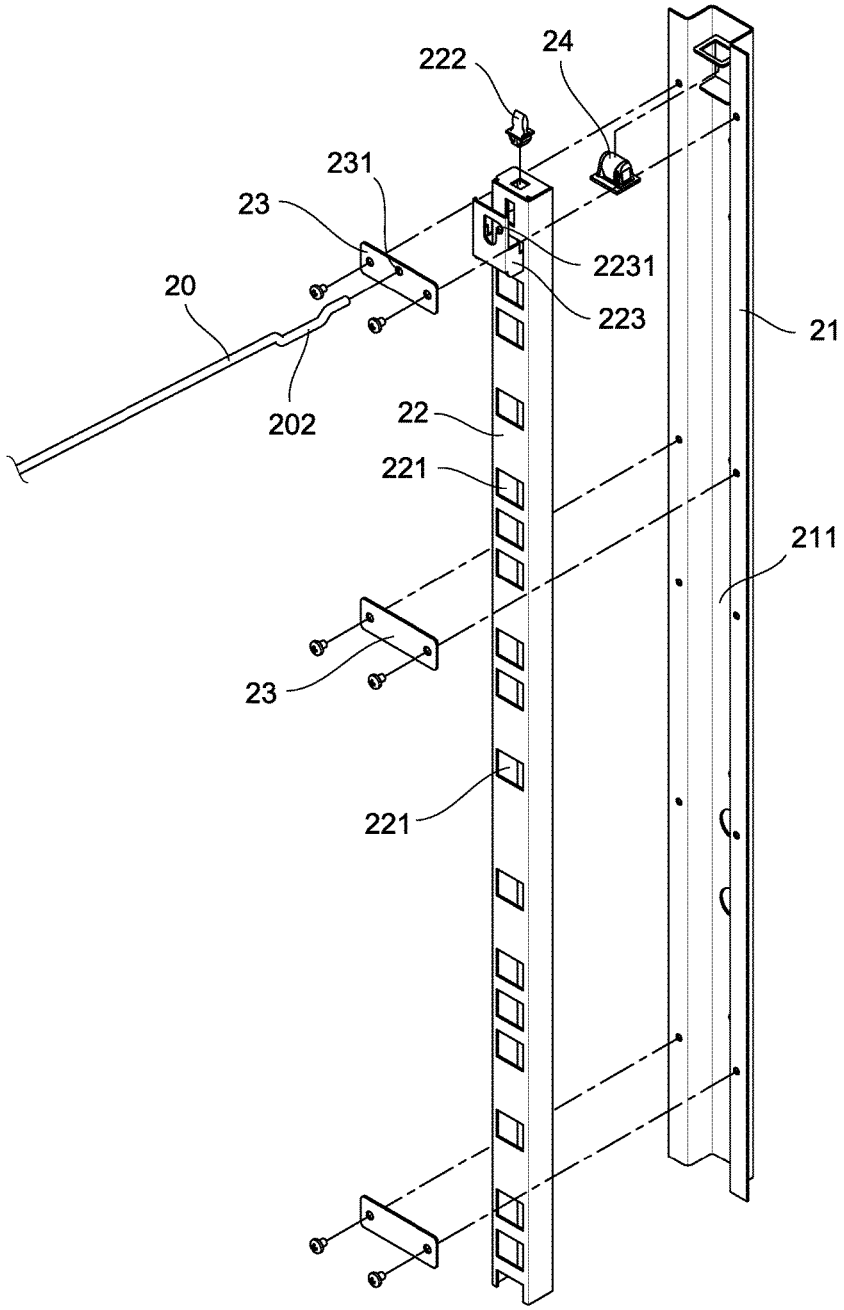
FIG. 4 is an exploded view of the locking device.
Figure 5:
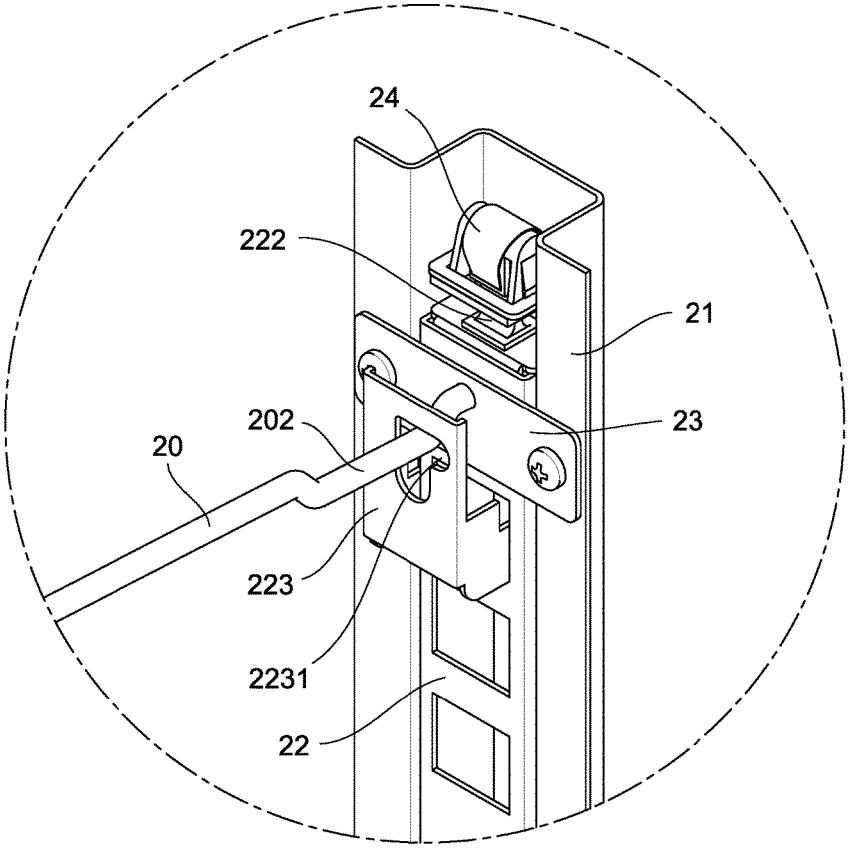
FIG. 5 is a detailed view of an area in circle A of FIG. 3, the locking device being unlocked.
Figure 6:
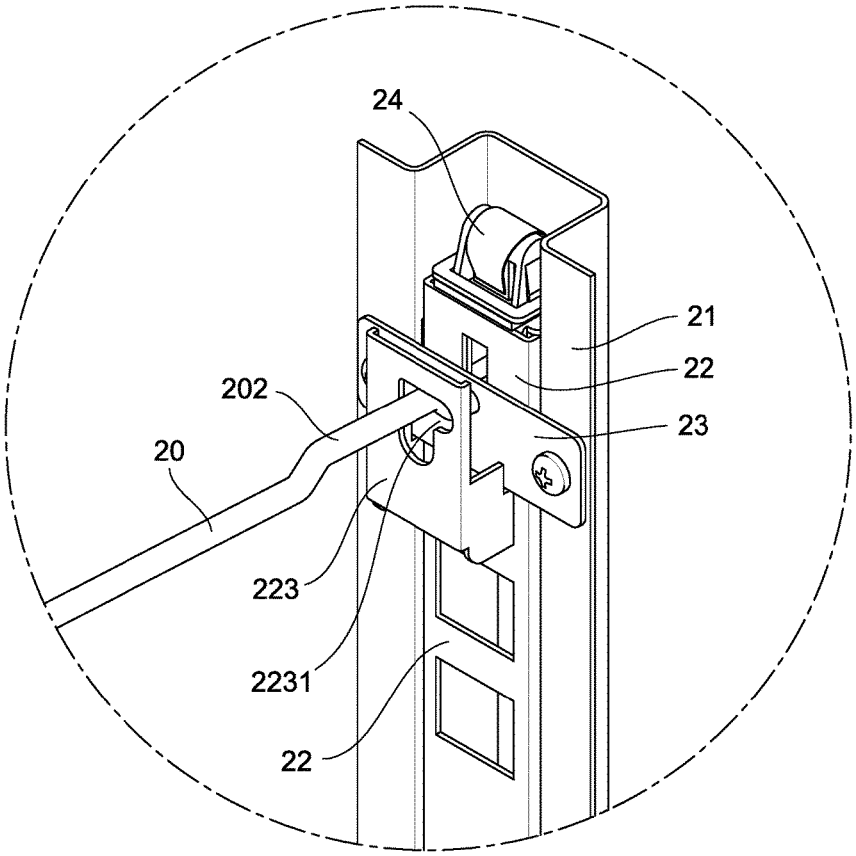
FIG. 6 is a view similar to FIG. 5, the locking device being locked.
Figure 7:
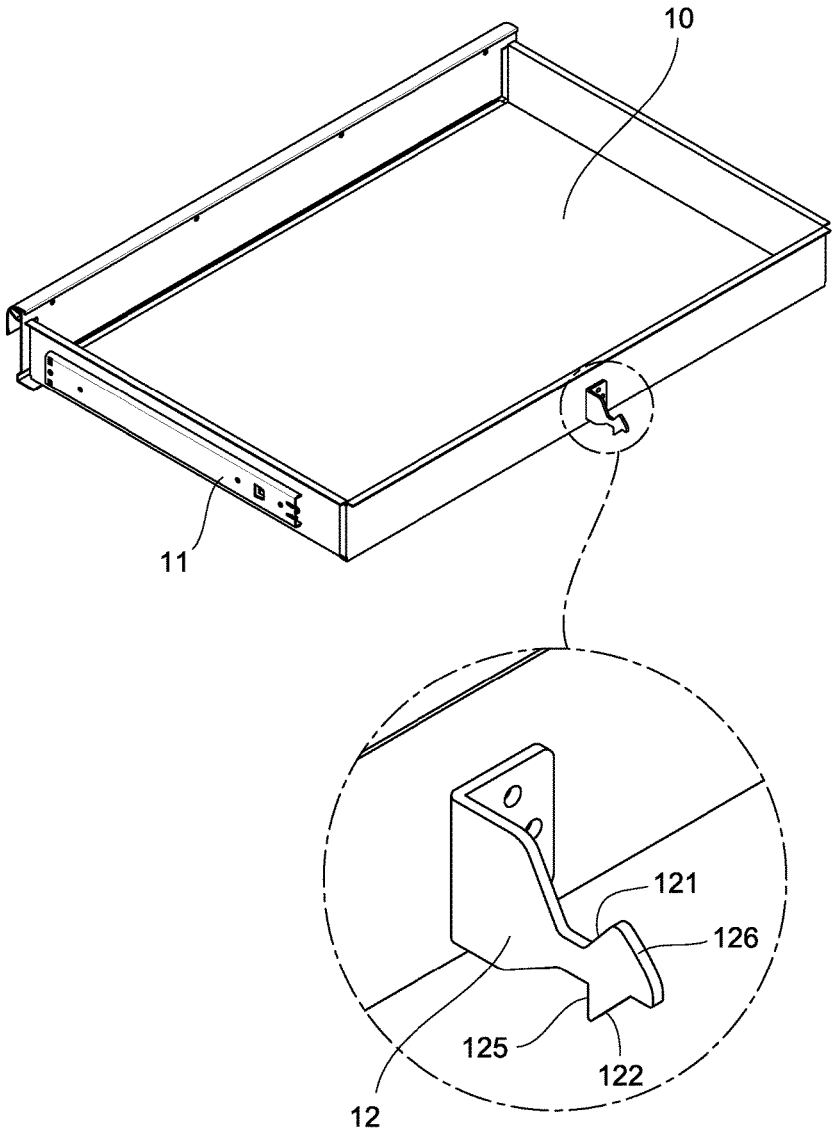
FIG. 7 is a perspective view of the drawer with a slide mounted on each of two sides thereof.
Figure 8:
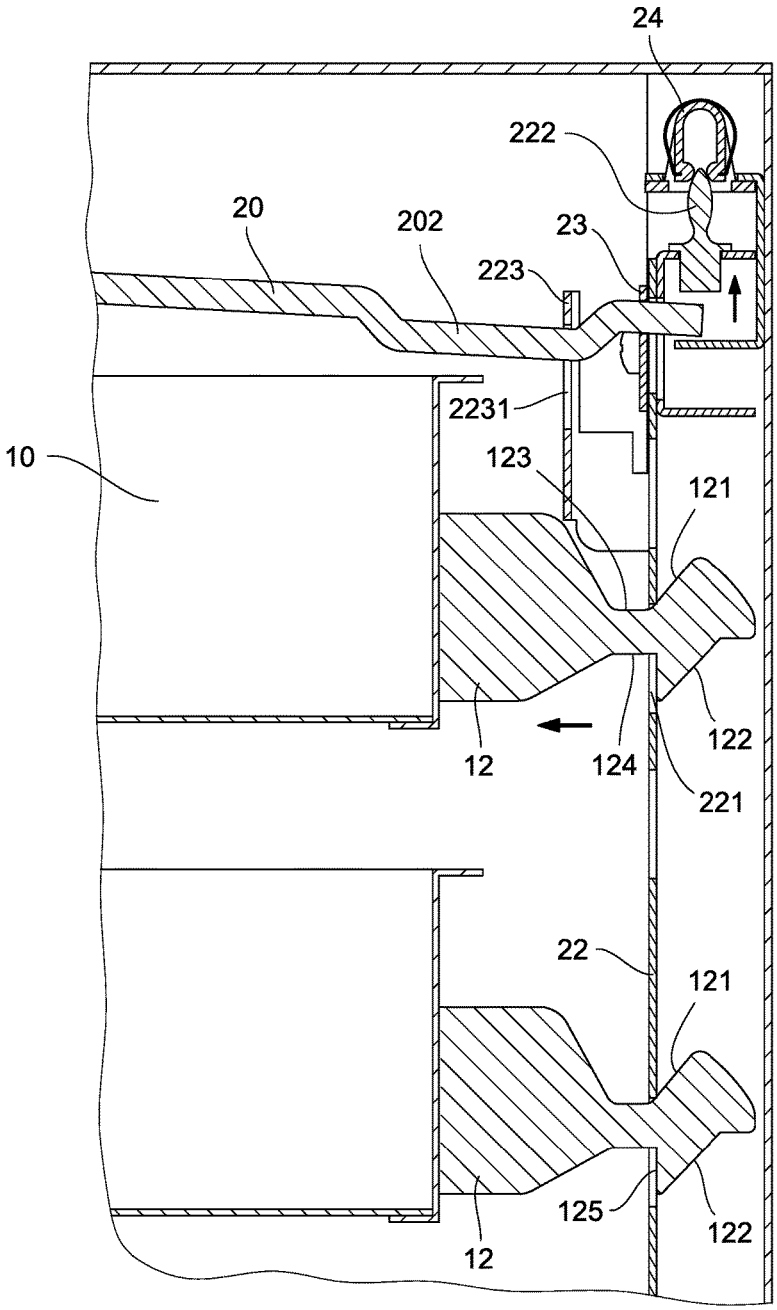
FIG. 8 is a longitudinal sectional view of FIG. 5.
Figure 9:
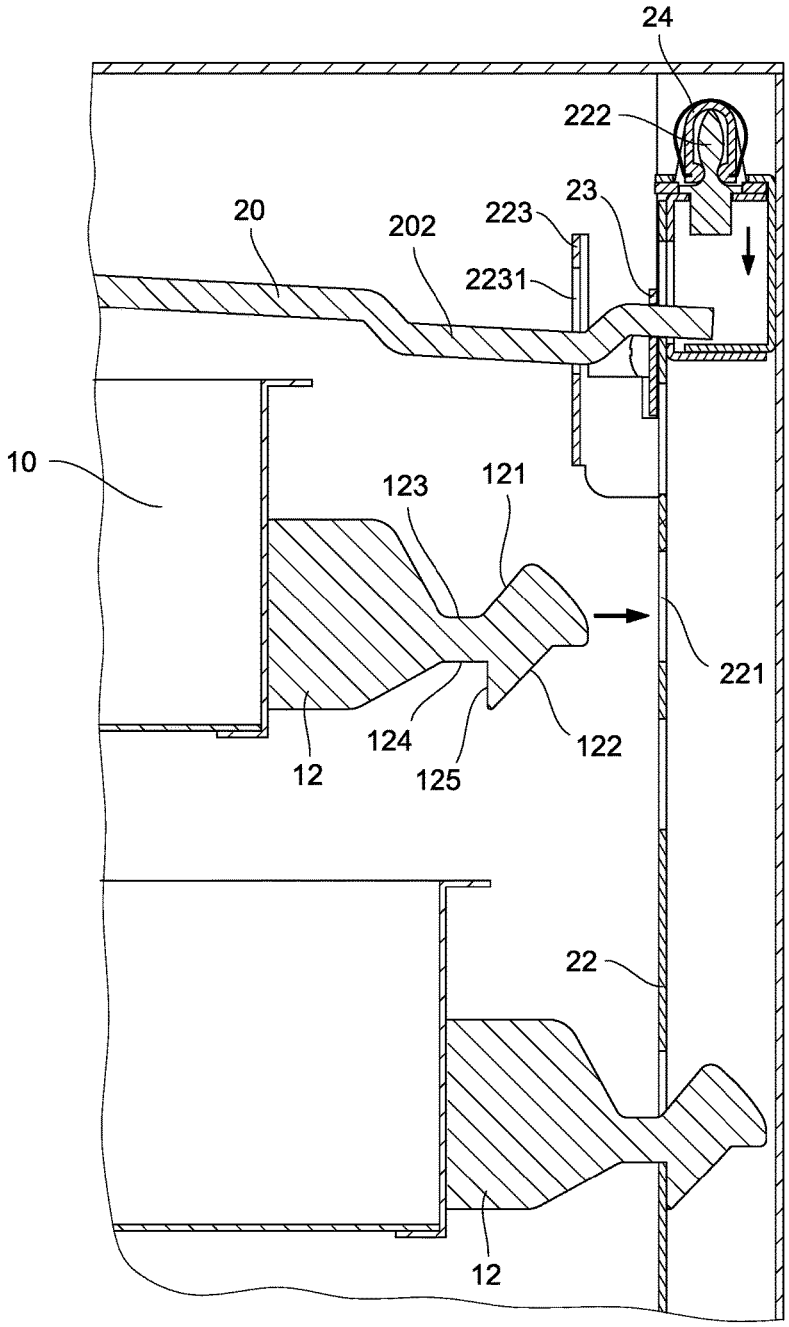
FIG. 9 is a longitudinal sectional view of FIG. 6.
Figure 10:
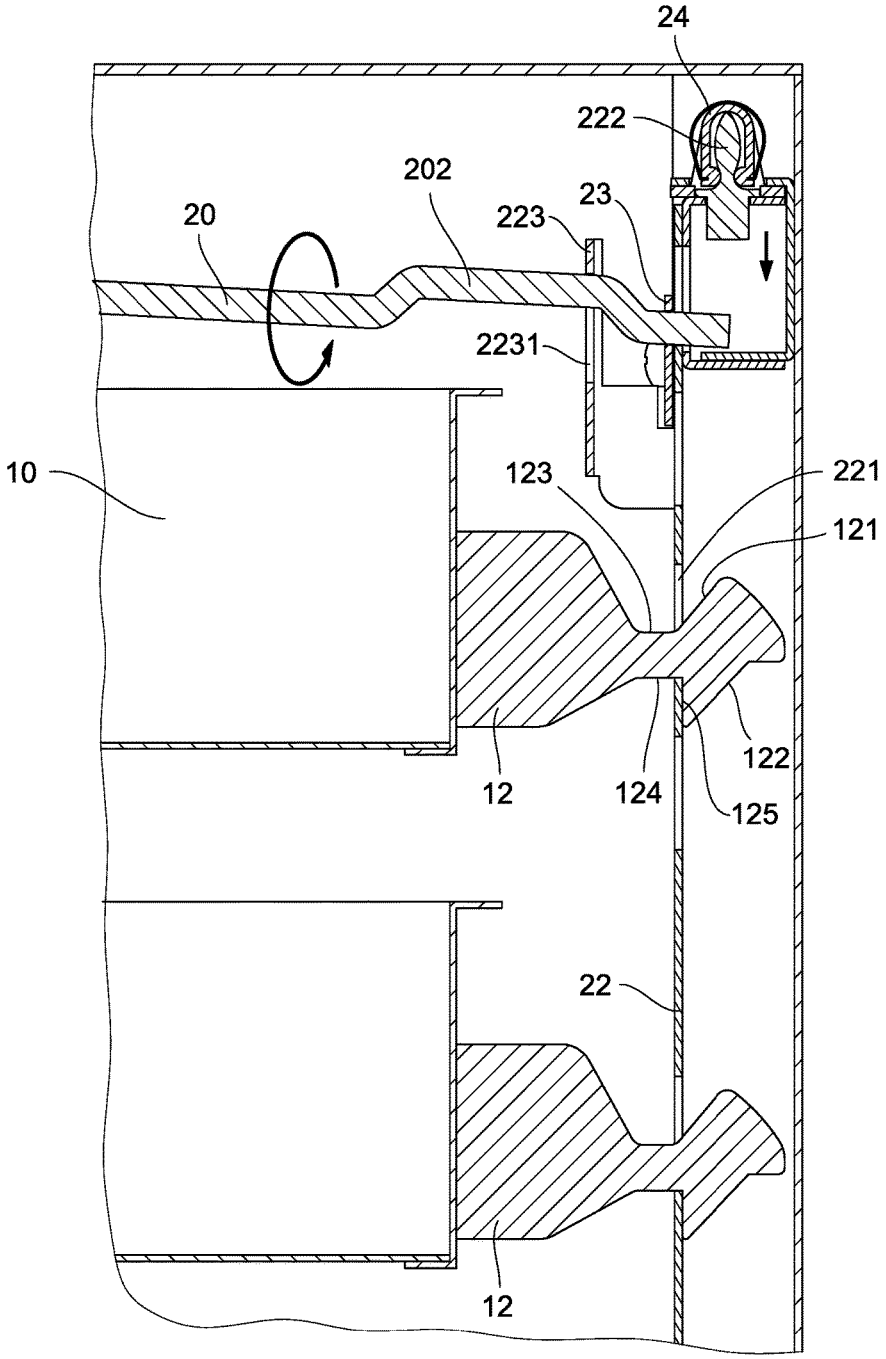

Referring to FIGS. 1 to 10, a wheeled cabinet 1 incorporating a key driven internal locking device 2 in accordance with the invention is shown. The cabinet 1 comprises a plurality of drawers 10 each including two slides 11 on outer surfaces of two sides respectively, and a latch 12 on an outer surface of a rear end. The latch 12 includes an upper inclined surface 121, an upper projection 126 in rear of the upper inclined surface 121, a lower inclined surface 122, an upper flat surface 123 in front of the upper inclined surface 121, a lower flat surface 124 in front of the lower inclined surface 122, and a shoulder 125 between the lower inclined surface 122 and the lower flat surface 124.

The key driven internal locking device 2 comprises a rod 20 including a key hole 201 on a front end, and a bent member 202 adjacent to a rear end; a longitudinal member 21 secured to an inner surface of the rear end of the cabinet 1 and including a longitudinal groove 211; a hollow sliding member 22 slidably disposed in the groove 211 and including a plurality of rectangular openings 221 on a front surface in which some openings 221 correspond to the latches 12, a protrusion 222 on a top of the sliding member 22, and an upper driven member 223 secured to the front surface of the sliding member 22 and having a through hole 2231 with the bent member 202 passing through; a plurality of fastening plates 23 each secured to two sides of the longitudinal member 21 in which the uppermost fastening plate 23 has a pivot hole 231 with the rear end of the rod 20 passing through into the longitudinal member 21 to be positioned therein; and a concave member 24 fastened in an upper portion of the longitudinal member 21 and above the protrusion 222.

In a locked state of the cabinet 1, the bent member 202 projects upward, the protrusion 222 is complementarily disposed in the concave member 24, the latch 12 is inserted into the rectangular opening 221, and the shoulder 125 of the latch 12 is blocked by an inner surface of the front surface of the sliding member 22. Thus, all drawers 10 are locked.

A user may insert a key 3 into a key hole 201 and clockwise rotates the key 3. And in turn, the rod 20 clockwise rotates to push the driven member 223 downward. Also, the sliding member 22 moves downward to clear the protrusion 222 out of the concave member 24, and the shoulder 125 of the latch 12 is not blocked by the inner surface of the front surface of the sliding member 22. Thus, all drawers 10 are unlocked.

It is envisaged by the invention that only one drawer 10 can be pulled out in one operation. This is because when one drawer 10 is pulled out, the upper inclined surface 121 of the latch 12 pushes the front surface of the sliding member 22 upward to insert the protrusion 222 into the concave member 24 and the shoulders 125 of the latches 12 of the remaining drawers 10 are blocked by the inner surface of the front surface of the sliding member 22. Thus, all of the remaining drawers 10 are locked. This has the advantage of preventing all drawers 10 from being pulled out in one operation. Otherwise, the cabinet 1 may fall due to movement of the gravity thereof.

While the invention has been described in terms of preferred embodiments, those skilled in the art will recognize that the invention can be practiced with modifications within the spirit and scope of the appended claims.

What is claimed is:

1. A cabinet comprising:

a plurality of drawers each comprising two slides on outer surfaces of two sides respectively, and a latch disposed on an outer surface of a rear end and including an upper inclined surface, an upper projection in rear of the upper inclined surface, a lower inclined surface, an upper flat surface in front of the upper inclined surface, a lower flat surface in front of the lower inclined surface, and a shoulder between the lower inclined surface and the lower flat surface; and a key driven internal locking device comprising:

a rod including a key hole on a front end, and a bent member adjacent to a rear end;

a longitudinal member secured to an inner surface of a rear end of the cabinet and including a longitudinal groove;

a sliding member slidably disposed in the longitudinal groove and including a plurality of rectangular openings on a front surface wherein a predetermined number of the rectangular openings correspond to the latches, a protrusion on a top of the sliding member, and an upper driven member secured to the front surface of the sliding member and having a through hole with the bent member passing through;

a plurality of fastening plates each secured to two sides of the longitudinal member wherein an uppermost one of the fastening plates has a pivot hole with the rear end of the rod passing through into the longitudinal member; and a concave member fastened in an upper portion of the longitudinal member and above the protrusion;

wherein in a locked state of the cabinet, the bent member projects upward, the protrusion is disposed in the concave member, each latch is inserted into the corresponding rectangular opening, each latch is blocked by an inner surface of the front surface of the sliding member, and all of the drawers are locked;

wherein in response to inserting a key into the key hole and clockwise rotating the key, the rod clockwise rotates to push the driven member downward, the sliding member moves downward to clear the protrusion out of the concave member, the latches are not blocked by the inner surface of the front surface of the sliding member, and all of the drawers are unlocked;

wherein in response to pulling out one drawer in one operation, the latch pushes the front surface of the sliding member upward to insert the protrusion into the concave member and the latches of the remaining drawers are blocked by the inner surface of the front surface of the sliding member, and the remaining drawers are locked;

wherein in response to pulling out one drawer in one operation, the upper inclined surface of the latch pushes the front surface of the sliding member upward to insert the protrusion into the concave member and the shoulders of the latches of the remaining drawers are blocked by the inner surface of the front surface of the sliding member; and wherein in response to pulling out one drawer in one operation, all of the remaining drawers are locked and prior to pulling out a second drawer, one drawer is pushed in with the lower inclined surface of one drawer pushes down the sliding member so that the shoulders of the latches are not blocked by the inner surface of the front surface of the sliding member.

* * * * *